US005460114A

United States Patent [19]

McMillan

[11] Patent Number: 5,460,114

[45] Date of Patent: Oct. 24, 1995

[54] FLOAT FOR DOCK CONSTRUCTION

[75] Inventor: Robert L. McMillan, Westport, Mass.

[73] Assignee: New England Plastics Corporation, Woburn, Mass.

[21] Appl. No.: 277,752

[22] Filed: Jul. 20, 1994

[51] Int. Cl.[6] ..... B63B 35/44

[52] U.S. Cl. ..... 114/267; 114/266

[58] Field of Search ..... 114/263, 266, 114/267, 352; 405/219

[56] References Cited

U.S. PATENT DOCUMENTS

| | | | |
|---|---|---|---|
| 3,074,238 | 1/1963 | Golian | 405/219 |
| 3,179,076 | 4/1965 | Sheffield | 114/267 |
| 4,733,626 | 3/1988 | Svirklys | 114/267 |
| 5,199,370 | 4/1993 | Berquist | 114/267 X |
| 5,355,825 | 10/1994 | Lefebvre et al. | 114/267 |

*Primary Examiner*—Sherman Basinger
*Attorney, Agent, or Firm*—Robert J. Doherty

[57] ABSTRACT

A float or floats for use with a marine dock structure in which a body in the form of a hollow rectangular block formed of resinous plastic material is provided with a bottom slot in which a board or other mechanism is inserted to space the float bottom wall from the supporting surface when the floats or dock structures in which the floats are a part of are dragged or otherwise moved across the ground to facilitate repair or storage and in which fasteners are provided for attaching the floats to such dock structure.

10 Claims, 7 Drawing Sheets

FLOAT FOR DOCK CONSTRUCTION

BACKGROUND AND OBJECTS OF THE INVENTION

This invention relates to aquatic dock structures and particularly a float on floats upon which such door structures rest and provide the buoyancy therefore. Generally, such floats are provided in multiples, that is, enough floats are added together either lengthwise, sideways or vertically stacked in order to provide a sufficient area and sufficient buoyancy upon which the uppermost portions of the dock structure can be assembled—generally a deck but including frames, supporting posts and other equipment which is commonly supplied for this specific purpose. Also, single float dock structures exist and although the present invention will be described in connection with specific features to allow for multiple float stacking and alignment it should be clear that both single float and multiple float dock constructions are of interest and the invention relates to both such constructions.

Presently, there are several types of floats available and proposed for use in such dock constructions. The most commonly used float is simply a block of expanded foam plastic such as polystyrene commonly referred as EPS. When such blocks are positioned beneath a dock structure in such position either by some dock framework or other positioning means such as netting, attachment rails or the like, the natural buoyancy of the foam block provides the necessary support for the dock generally in the form of a deck supported by the dock structure. EPS does, however, rapidly break down especially when exposed to sunlight and is further environmentally dangerous to marine life such as fish, birds and turtles that eat indigestible chunks of such material which cannot be readily passed and therefore expire as a result thereof. Such material is further unsightly. EPS floats are further easily damaged when it is required to drag the dock structure on which they rest ashore for repairs.

Other dock structures utilize either thermo formed or blow molded floats which are generally made in two or more pieces which are then interconnected to form a hollow interior but such resultant floats are necessarily of both a thin walled and varied thickness wall construction which subjects them to tearing and rupturing when the docks formed thereon are dragged on shore for repairs similar to the problems associated with the EPS units. It has also been proposed to fill such hollow floats with an expanded foam material to provide strength and rigidity, however, such units have added problems of making it more difficult to repair the outer shells thereof should rupture occur and when leakage to the interior does occur, the foam tends to become water logged causing the floats to list and or sink.

Accordingly, the need exist for a float structure which avoids the above indicated prior art deficiencies but which also accomplishes the necessary objectives of strength, rigidity, buoyancy and an ability to withstand abrasion normally caused by the aforementioned dragging of the dock structures across the shoreline for land based repairs.

These and other objects of the present invention are accomplished by a supporting system for aquatic docks comprising at least one float, each said float having a hollow imperforate thin wall body of a generally rectangular block-like shape and having opposed generally planar upper and lower surfaces, said body lower surface including an inwardly recessed open ended generally U-shaped recessed slot longitudinally extending along the entire extent of said lower surface, said slot having opposed side walls and a bottom wall interconnecting said side walls, said body further including a plurality of longitudinally spaced, vertically oriented separate channels extending between said upper and lower body surfaces so as to form a plurality of longitudinally spaced vertically disposed tubular connection posts through said body, said vertical tubular posts terminating in unobstructed holes at both said upper and lower body wall surfaces with said holes at said lower wall surface positioned in said slot, a longitudinally oriented board having upper and lower surfaces positioned in said slot, said board of a vertical height substantially greater than the depth of said slot such that the board lower surface is positioned beneath said body lower wall surface so as to form a supporting surface for contact with the ground when said float is dragged across the ground, said board further having a plurality of vertical openings aligned with the tubular post openings in said slot and connecting means passing through said posts and said board for fastening said board to said body, said tubular posts having imperforate vertically oriented walls connected to and extending between said body upper and lower walls to maintain the hollow imperforate interior of said body.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
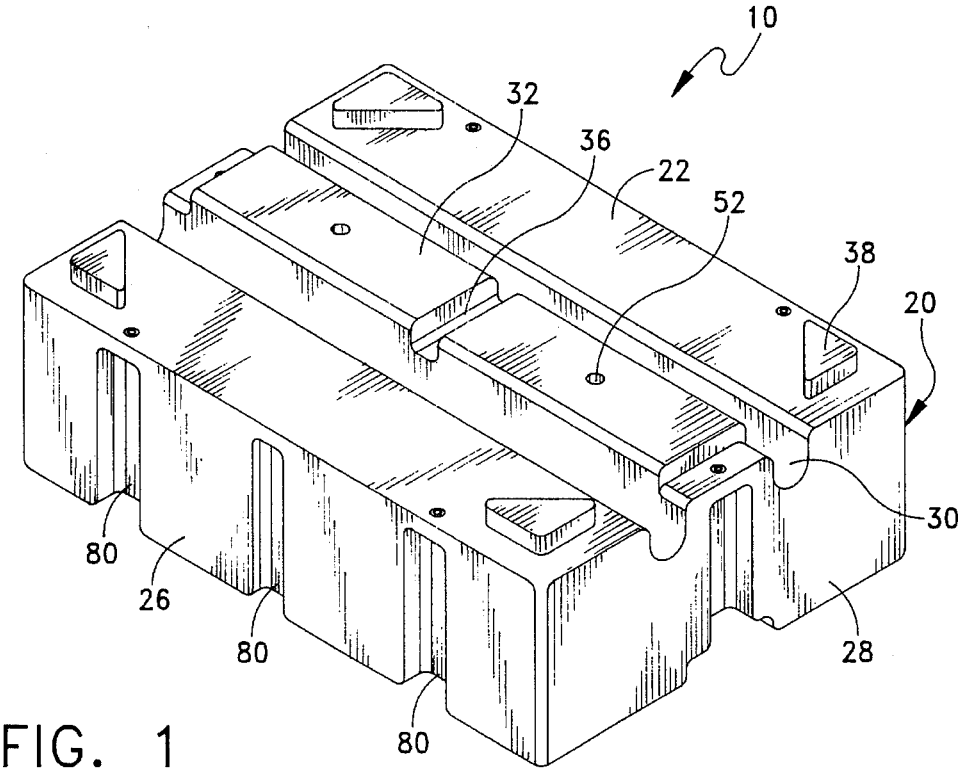
FIG. 1 is a top perspective view of a single float unit made in accordance with the present invention.
Figure 2:
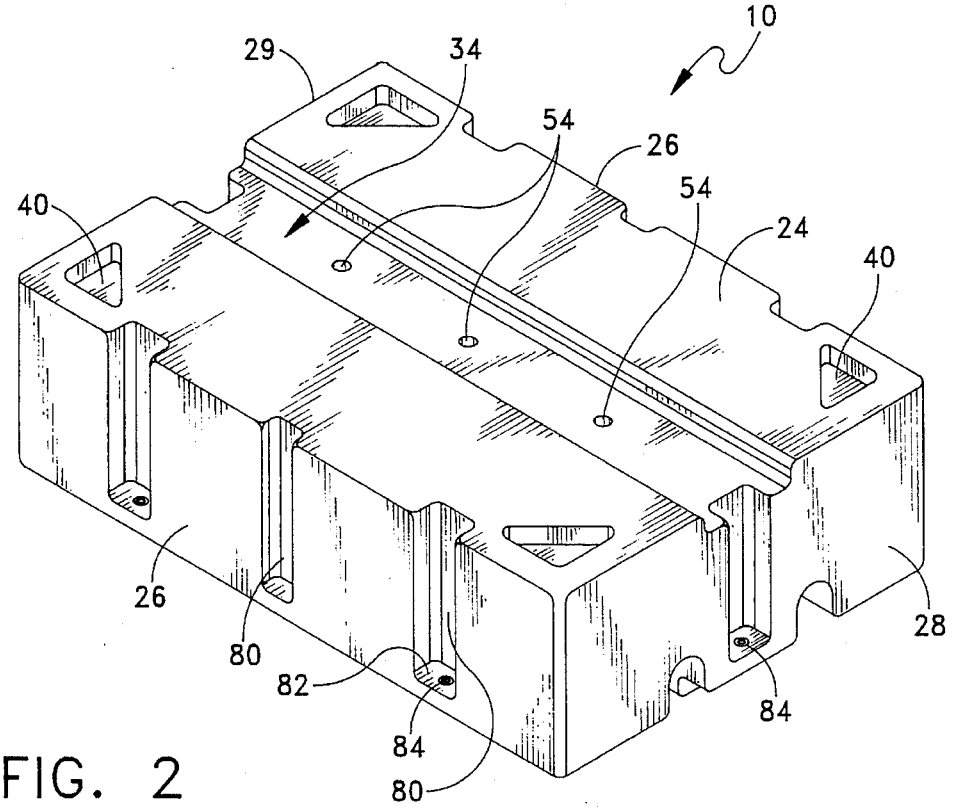
FIG. 2 is a bottom perspective view similar to FIG. 1.
Figure 10:
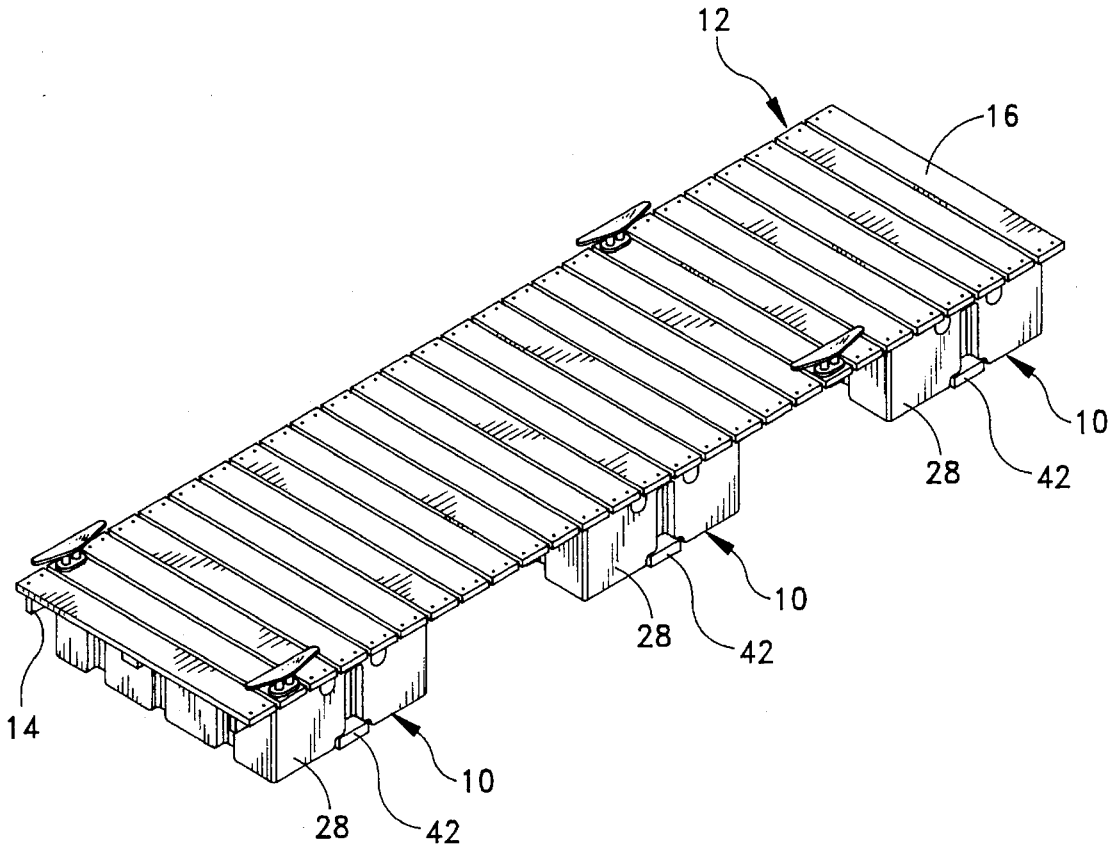
FIG. 10 is a perspective depiction of one type of dock construction that can be formed utilizing a plurality of floats made in accordance with the present invention.

Turning now to the drawings and particular FIGS. 1, 2 and 10, the float 10 of the present invention is shown in top, bottom and use positions respectively. Thus in FIG. 10, three such floats are shown supporting a dock 12 including a framework 14 and a deck structure 16 in turn supported thereon. It should be brought out that the FIG. 10 representation is for illustrative purposes and while such shows three floats 10 in laterally separated positions from each other, the floats could alternatively be placed in adjacent contact with each other either laterally, longitudinally or stacked on top of one another or any combination of the above alternative use positions dependent on the requirements for support, buoyancy, height above the water line and other considerations dependent upon the dock type being supported and the use conditions of the environment.

Turning now to FIGS. 1 and 2 particularly, it should be pointed out that the float 10 preferably takes the form of a body 20 of generally rectangular configuration having upper and lower wall surfaces 22 and 24 respectively as well as opposed side wall surfaces 26 and front and rear wall surfaces 28 and 29 respectively. The float 10 overall configuration is thus of a generally rectangular block having the surface wall portions thereof of a generally planar extent such that adjacently disposed floats will be in close contacting position to each other as is desired. Preferably, the float 10 is formed from a low cost plastic material such as polyethylene and is preferably rotationally molded to provide an even wall thickness thereto not normally attainable by other forming techniques such as thermo forming and blow molding. An acceptable wall thickness that provides the necessary toughness and rigidity is 3/16" polyethylene.

Figure 3:
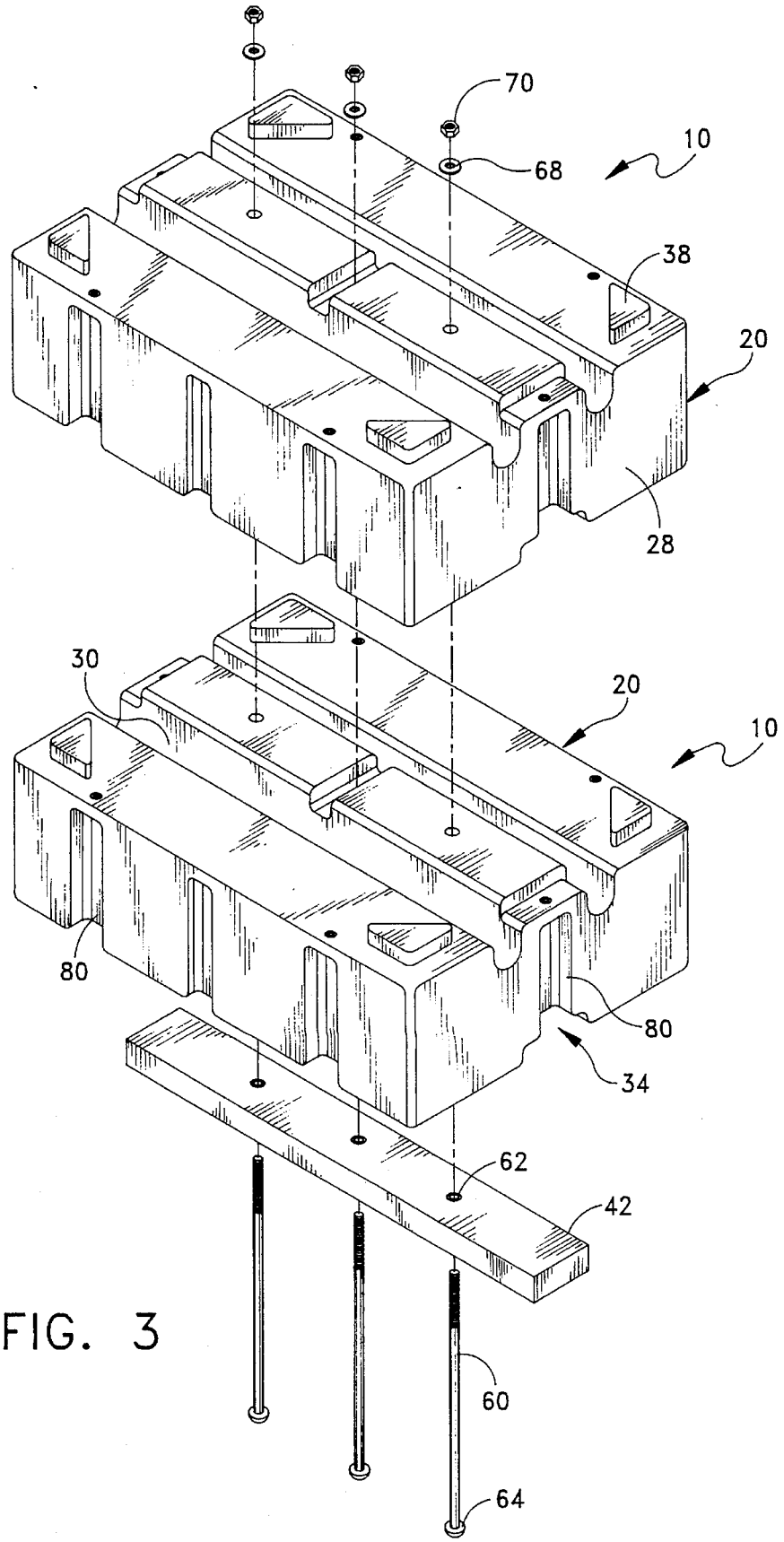
FIG. 3 is a exploded perspective view showing the manner in which the bottom support board may be connected to one or more stacked floats.
Figure 5:
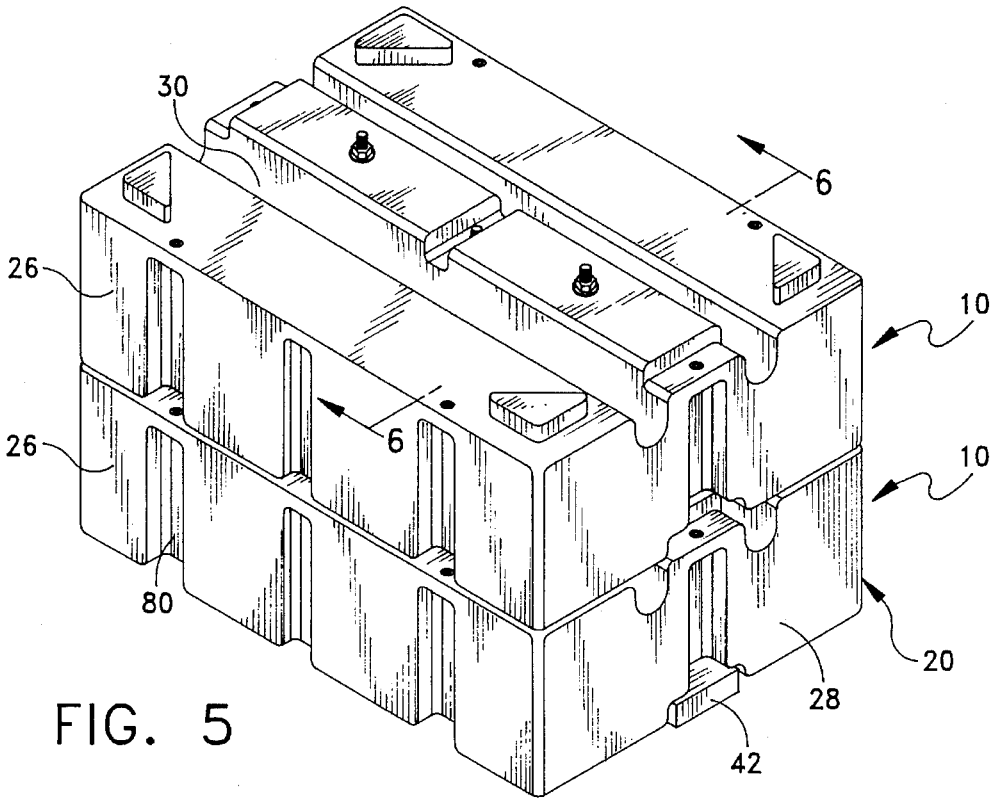
FIG. 5 is a perspective view similar to FIG. 3 showing two stacked float units in assembled condition.
Figure 6:
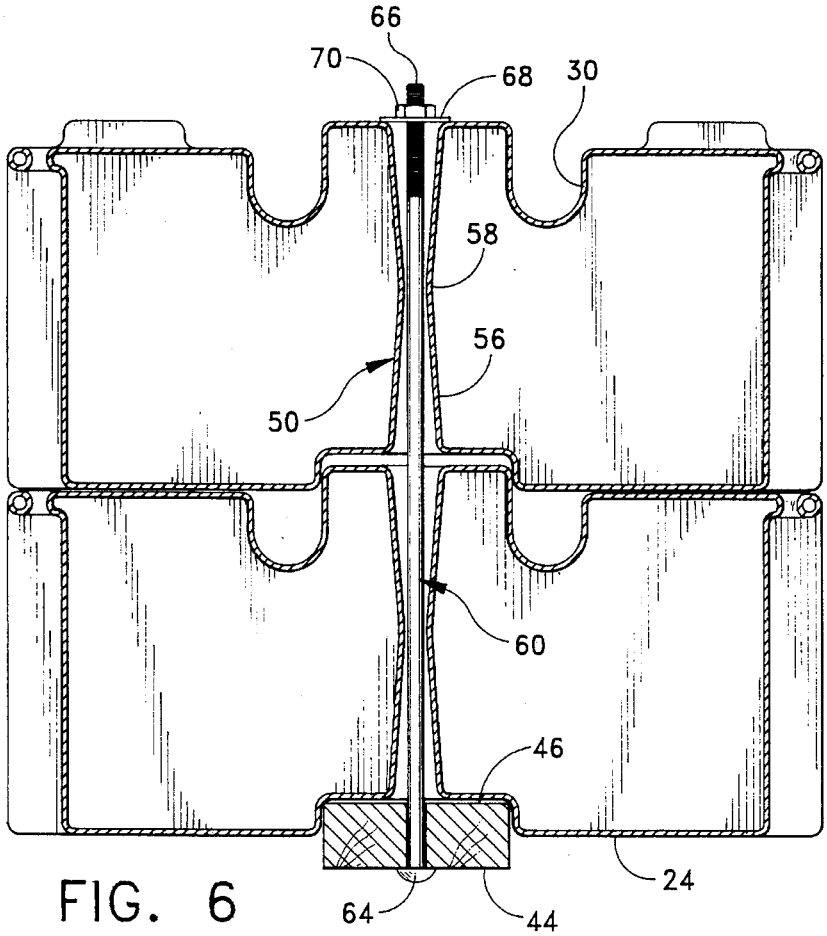
FIG. 6 is a sectional elevation view taken along the line 6—6 of FIG. 5.
Figure 7:
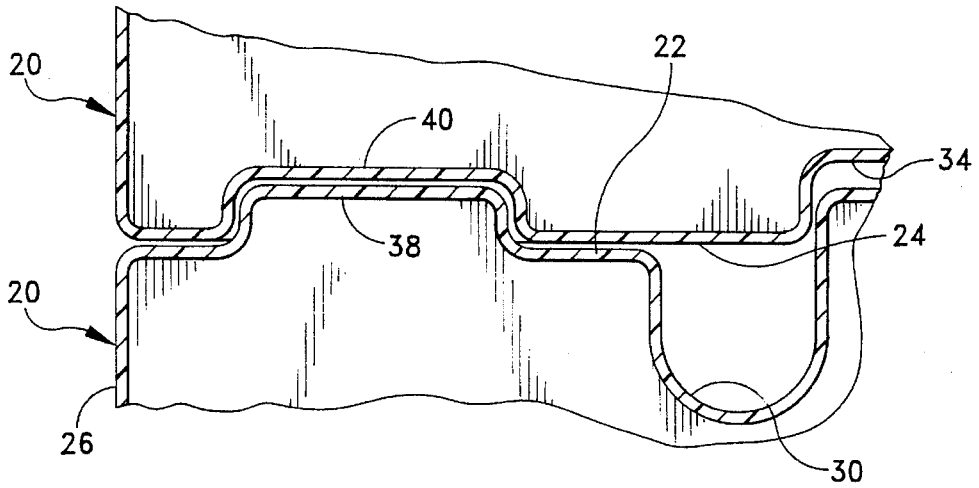
FIG. 7 is an enlarged view of a portion of FIG. 6.

The upper surface wall 22 includes a pair of laterally spaced longitudinally extending rigidity grooves 30 which not only impart rigidity but may additionally be utilized to accommodate part of the dock 12 framework or other tubular structures in which wiring, water, etc. may be provided. The central portion of the upper surface wall 22 includes an elevated pad 32 adapted to in part interlock with a longitudinal groove 34 formed in the bottom wall surface 24 and additionally with a cross groove 36 laterally extending across the pad 32 also to accommodate conduits, etc. for the dock 12. In addition to the above-described interlock between the pad 32 and the groove 34, the upper surface 22 is further provided with a series of upstanding bosses 38 preferably at the corners thereof for inter fitment with similarly shaped depressions 40 in the lower surface 24 which are further vertically oriented therewith. Such interlocking relationship of the vertically stacked floats 10 is particularly shown in FIGS. 3, 5 and 6 of the drawings.

In addition to the above referred to stacking feature, the longitudinal slot 34 forms another and particularly important feature best shown in FIGS. 3 through 6 of the drawings wherein a longitudinally oriented board 42 or **42*a* dependent on its length is affixed into the slot in a particular relationship. Although the particular dimensions of the board 42 or 42*a* are not critical, the thickness of such board should be such that its lower surface 44 projects vertically beyond but is below the general planar extent of the lower wall surface 24 such when the float or flock and dock structure which the floats are designed to support is pulled ashore for repairs or storage during the winter or the like, the lower surface or surfaces 24 thereof are suitably spaced above the ground over which such structures must be dragged or otherwise moved to reduce the contact between the ground and the float structure lower portions to prevent rupture, abrasion or other damage that might otherwise be formed if it were not for presence of these boards. A suitable board dimension which has been found suitable for this purpose is dimensional 2×6 lumber which has been water-proof treated and approximately an inch or slightly greater of its vertical thickness extends below the lower wall surface 24**.

Figure 4:
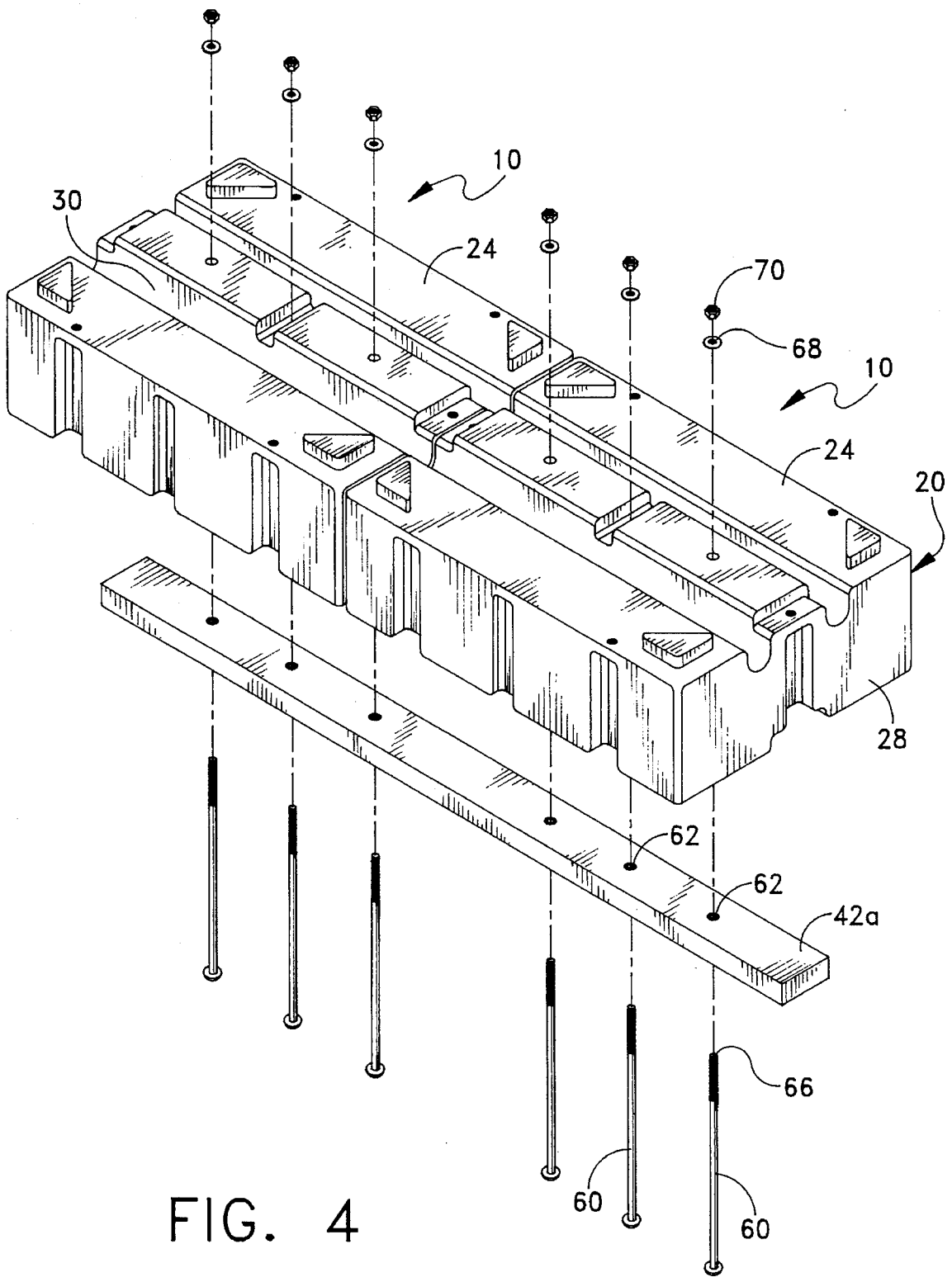
FIG. 4 is a perspective view similar to FIG. 3 but showing the manner in which a bottom support board is utilized to connect float units disposed in front to rear relationship.

When two or more floats 10 are positioned in front to back relationship as shown in FIG. 4, the board length **42*a* is increased such that a single length spans the floats 10, it being clear that the slots 34 thereof are positioned in alignment with each other and thus the board 42** serves to additionally join and connect the floats together as will hereinafter be more apparent.

The manner in which the board 42 is attached to the float 10 is best shown by reference to FIGS. 3 through 6 in which it should be pointed out that each float is provided with a plurality of longitudinally spaced tubular posts 50 which pass entirely through the thickness of the float and terminate at upper and lower holes 52 and 54 which respectively exit at the upper and lower wall surfaces 22 and 24. With respect to the lower wall surface 24, such holes 54 exit in the slot 34. The walls 56 of the posts are, of course, imperforate such that water cannot enter into the float interior portions. The walls 56 also exhibit an inward taper from both ends thereof to a diminished diameter center section 58—the thickness of which is at least equal to or slightly greater than that of bolts or other fastening means passing therethrough. The board 42 is also provided with longitudinally spaced holes 62 such that the bolts 60 pass therethrough and the head 64 of the bolt engages the surrounding lower surfaces 44 of the board 42. The upper or threaded end 66 of the bolt is provided with a washer 68 and a nut 70 such that board 42 or **42*a* is firmly affixed to the float in this manner. Also, the portion of the threaded bolts ends 66 which extends above the top wall surface 22 is in line with the slot 34 in those cases where floats 10 are stacked vertically with respect to each other. Similarly as previously mentioned when the floats 10 are positioned in longitudinal front to rear alignment such as shown in FIG. 4, the board 42*a*** via the above mentioned connection means serves to firmly connect the floats to each other.

Figure 1A:
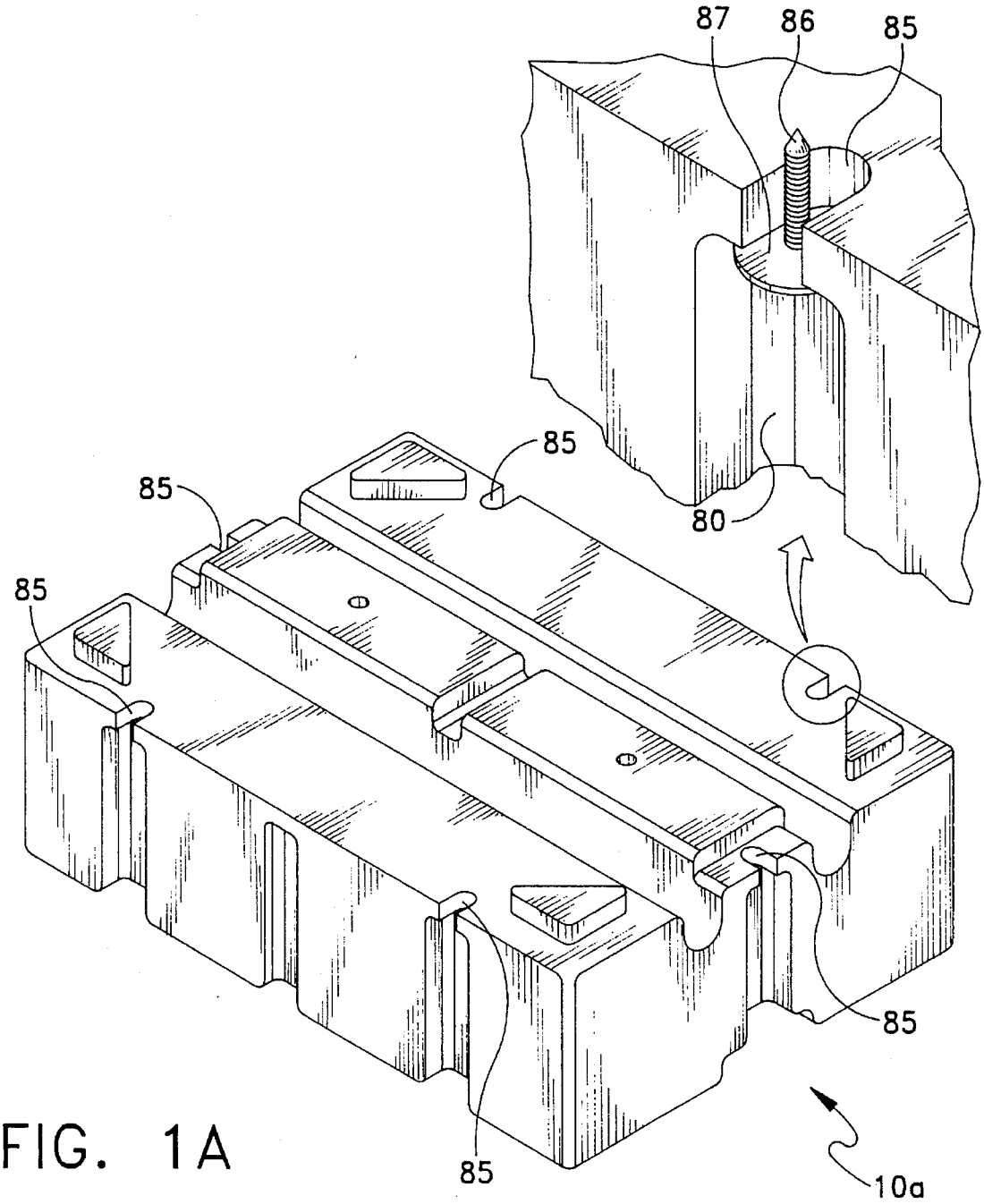
FIG. 1A is a top perspective view similar to FIG. 1 but showing a modified form of construction.
Figure 8:
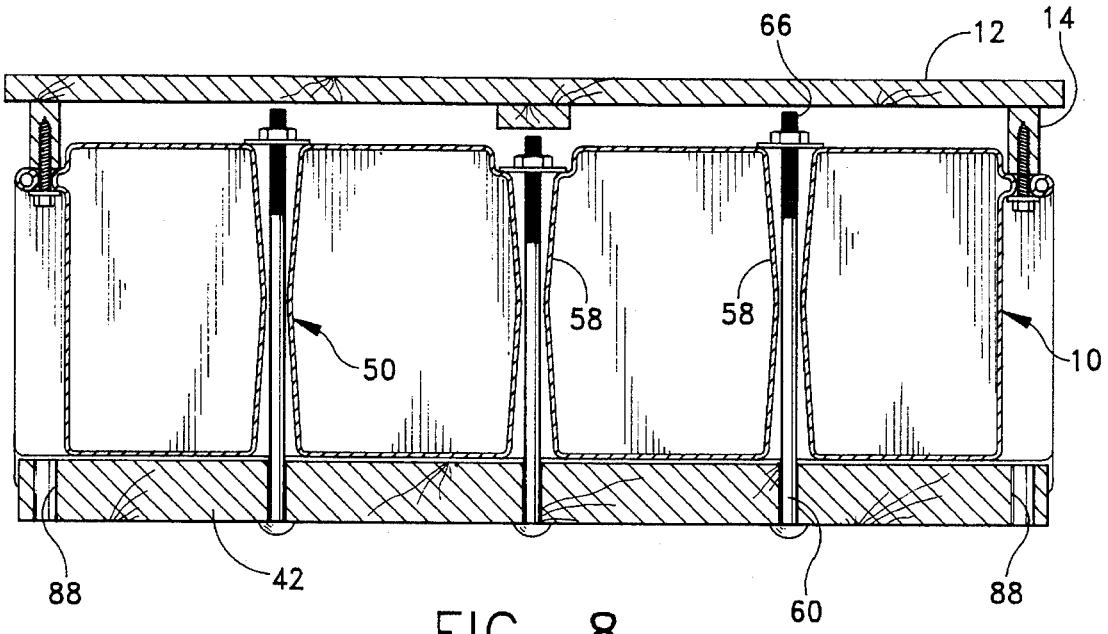
FIG. 8 is a side sectional elevation view showing the manner in which a single float can be utilized to support an overlying dock structure segment.
Figure 9:
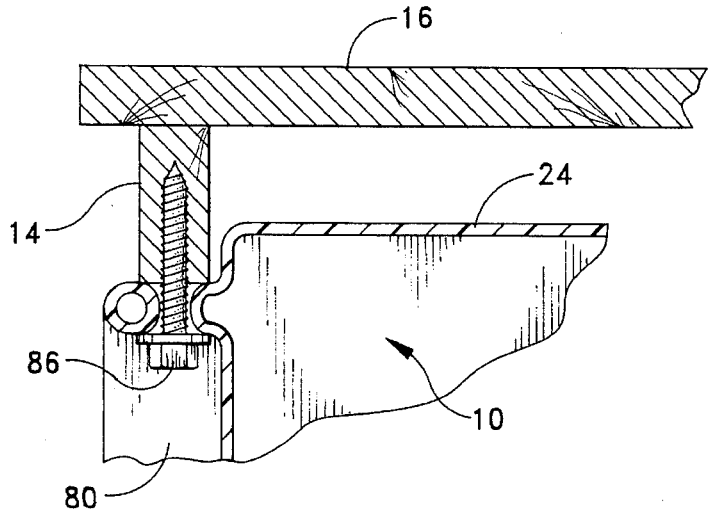
FIG. 9 is a detail of FIG. 8 showing a specific manner in which the dock frame may be attached the float.

In order to better facilitate the dock 12 connection to the floats and especially through the framework 14 thereof, the side walls 26 as well as the front and rear walls 28 and 30 respectively may be provided with one or more vertically oriented grooves 80 upwardly extending from the bottom wall 24 and terminating at their upper portion in an integral flange 82 further provided with an opening 84 such that screws or bolts 86 may be passed upwardly therethrough and into connecting attachment with the framework 14. It is preferable to form such grooves 80 in the front and rear walls 28 and 29 in longitudinal alignment with the slot 34 such that the flanges 84 thereof vertically overlie the board 42 or **42*a* and in that respect, it is possible to interconnect the boards with the framework 14 as by passing an elongated fastening member such as screw or bolt upwardly through secondary holes 88 formed in the board such as shown in FIG. 8 of the drawings such that such fastening means may, in effect, tie the board and framework 14 together. Also as best shown in FIG. 1A, the openings 84 may be omitted and an open slot 85 utilized instead for receipt of the screws or bolts 86 in which case the use of a washer 87 is recommended. In such alternate arrangement as shown in FIG. 1A, it is easier to disconnect the float 10*a* from the frame 14** when desired.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A supporting system for aquatic docks comprising at least one float, each said float having a hollow imperforate thin wall body of a generally rectangular block-like shape and having opposed generally planar upper and lower surfaces, said body lower surface including an inwardly recessed open ended generally. U-shaped recessed slot longitudinally extending along the entire extent of said lower surface, said slot having opposed side walls and a bottom wall interconnecting said side walls, said body further including a plurality of longitudinally spaced, vertically oriented separate channels extending between said upper and lower body surfaces so as to form a plurality of longitudinally spaced vertically disposed, tubular connection posts through said body, said vertical tubular posts terminating in unobstructed holes at both said upper and lower body surfaces with said holes at said lower wall surface positioned in said slot, a longitudinally oriented board having upper and lower surfaces positioned in said slot, said board of a vertical height substantially greater than the depth of said slot such that the board lower surface is positioned beneath said body lower surface so as to form a supporting surface for contact with the ground when said float is dragged across the ground, said board further having a plurality of vertical openings aligned with the tubular post holes in said slot and connecting means passing through said posts and said board for fastening said board to said body, said tubular posts having imperforate vertically oriented walls connected to and extending between said body upper and lower surfaces to maintain the hollow imperforate interior of said body.

2. The system of claim 1, said connecting means including a threaded bolt.

3. The system of claim 1, said connection posts of circular cross section and inwardly tapered from each of the body upper and lower surface holes thereof towards a reduced diameter central section.

4. The system of claim 1, said body further including opposed front and rear wall surfaces and opposed side wall surfaces, said slot for receiving the board extending between said front and rear wall surfaces.

5. The system of claim 4, including a plurality of inwardly extending recesses formed in said opposed side wall surfaces and wherein the upper end of such recesses terminates in a flange having an opening therethrough for connecting said float to the deck structure of a dock.

6. The system of claim 5, said connection recesses and said flanges also formed in said front and rear wall surfaces.

7. The system of claim 6, the connection recesses formed in said front and rear surfaces aligned with said slot such that said board can be directly connected to said dock deck structure therethrough.

8. The system of claim 5, wherein said openings in said flanges are inwardly extending open-ended slots.

9. The system of claim 1, said body upper surface including upstanding bosses in each corner thereof and said body lower surface including indented recesses of similar configuration and in vertical alignment with said bosses such that the bosses extend into said indented recesses when two or more of said floats are vertically stacked.

10. The system of claim 1, there being two or more of said floats disposed in front to rear succession and wherein said board longitudinally extends along each of said floats.

* * * * *